US006837411B1

(12) United States Patent
Almeras et al.

(10) Patent No.: US 6,837,411 B1
(45) Date of Patent: Jan. 4, 2005

(54) FASTENING APPARATUS WITH INDIRECT FIRING

(75) Inventors: Roland Almeras, Tournon (FR); Patrick Herelier, Saint Jean de Muzols (FR); Emmanuel Vallon, Portes les Valence (FR)

(73) Assignee: Societe de Prospection et d'Inventions Techniquestspit, Bourg-les-Valence (FR)

( * ) Notice: Subject to any disclaimer, the term of this patent is extended or adjusted under 35 U.S.C. 154(b) by 0 days.

(21) Appl. No.: 10/730,259

(22) Filed: Dec. 9, 2003

(30) Foreign Application Priority Data

Dec. 11, 2002 (FR) ..... 02 15642

(51) Int. Cl.[7] ..... B25C 1/14
(52) U.S. Cl. ..... 227/10
(58) Field of Search ..... 227/9, 10, 130; 173/210, 211

(56) References Cited

U.S. PATENT DOCUMENTS 2,904,787 A * 9/1959 De Caro ..... 227/10
4,533,077 A * 8/1985 Jochum ..... 227/156
4,941,391 A 7/1990 Ehmig et al.
5,538,172 A * 7/1996 Jochum et al. ..... 227/10
5,881,940 A * 3/1999 Almeras et al. ..... 227/10
5,950,900 A * 9/1999 Frommelt et al. ..... 227/9
6,092,710 A * 7/2000 Kersten ..... 227/10
6,123,243 A * 9/2000 Pfister et al. ..... 227/10
6,478,207 B2 * 11/2002 Ehmig et al. ..... 227/10
6,481,609 B2 * 11/2002 Dittrich et al. ..... 227/10
6,505,767 B2 * 1/2003 Thieleke et al. ..... 227/10

FOREIGN PATENT DOCUMENTS

DE 201 00 837 U 7/1990

* cited by examiner

*Primary Examiner*—Scott A. Smith
(74) *Attorney, Agent, or Firm*—Lowe Hauptman Gilman & Berner, LLP

(57) ABSTRACT

In the apparatus, a fastening element is driven into a support under the action of the gases from an explosive charge via a piston (2) that can move in a gun between a firing position and a fastening position, and a plug guide (5) in which a piston-braking ball (6) mechanism is mounted, which comprises arms (7) mounted to pivot on the plug-guide (5) arranged to modulate the radial force of the balls (6), depending on the relative displacement of the gun (3) and of the piston (2), between a maximum force when the piston (2) moves forward in the gun, and a non-zero minimum force, when the piston (2) moves back.

5 Claims, 2 Drawing Sheets

FASTENING APPARATUS WITH INDIRECT FIRING

The invention relates to a fastening apparatus with indirect firing, by means of which a fastening element is driven into a support material under the action of propellent gases from an explosive charge via a piston mounted so that it can move in a barrel, between a firing position and a fastening position, and a plug guide in which a piston-braking, or retaining ball mechanism is mounted, exerting a radial force on the piston.

On firing, the piston was driven forward in the barrel, against the force from the ball mechanism, which is less that that of the explosive charge.

Under the action of piston resetting means, especially elastic return means, combustion gases or a pawl for returning the piston, which means remain the piston when the apparatus is opened by driving the barrel forward, the piston moves back relatively in the barrel.

When the apparatus is closed again, the barrel is displaced rearwards, driving the piston, which must always remain in its position relative to the barrel under the force from the braking balls.

In conventional braking-ball mechanism, the balls exert a force on the piston by virtue of a spring having a constant radial force, such that the force retaining the balls that must be overcome when the piston moves back in the barrel is the same as that exerted by the balls on the piston during firings.

Apparatuses have already been proposed with a mechanism to alleviate this drawback, for example the one described in U.S. Pat. No. 4,941,391. In this apparatus, in contrast, during the relative rearward displacement of the piston, the balls no longer exert a radial force on the piston, so that this piston could not be perfectly reset in the firing position.

Document DE 20100837 also discloses a further apparatus of the above mentioned type, in which the braking mechanism comprises frusto-conical shells with wedge-blocking action, arranged for modulating the radial action of the balls, as a function of the relative displacement of the barrel and the piston, between a maximal force, when the piston moves forwards in the barrel, and a non-null minimal force, when the piston moves backwards.

However, in this apparatus of the prior art, the braking effort of the blocking shells is modulated as a function of the sole displacement of the piston. Moreover, the braking shells are mounted against rubber elements which reduce their radial action.

The present application provides a more efficient mechanism for retaining the piston and of which the action is better metered out during the stroke of the piston.

Thus, the invention relates to a fastening apparatus with indirect firing, by means of which a fastening element is driven into a support material under the action of propellent gases from an explosive charge via a piston mounted so that it can move in a barrel, between a firing position and a fastening position, and a plug guide in which a piston-braking ball mechanism is mounted, exerting a radial force on the piston and comprising means arranged to modulate the radial force of the balls, depending on the relative displacement of the barrel and of the piston, between a maximal force when the piston moves forward in the barrel, and a non-null minimal force when the piston moves back, apparatus characterized by the fact that the balls are restrained radially by clamping lever arms for modulating the radial action of the balls, mounted so that they can pivot on the plug guide under the force of the balls rolling on the arms.

Preferably, the lever arms are also arranged in order to exert a rearward axial return force on the balls, should the latter move forward.

Still preferably, the balls are arranged in order to roll on the arms between retaining fingers at the end of the arms, away from elbows for pivoting the lever arms and a radial abutment edge of the plug guide which lies between the pivoting elbows and the retaining fingers of the arms.

Advantageously, each lever arm is mounted so that it can pivot against the force from a resilient o-ring.

Again advantageously, the radial thickness of each lever arm decreases rearwards.

Thanks to the invention, when the piston moves forwards, the angle formed between the articulated levers increases and the braking effort increases with this angle, so that this effort depends not only on the displacement of the piston but also on the angle between the lever arms.

When the piston is returned rearwards in the barrel under the action of the return means, the balls continue to exert a force on the piston. When the apparatus is opened, there is no risk of the piston being driven with a relative displacement in the wrong direction. It is ensured that the piston remains held in position. The balls are balls for braking and holding it in position in the barrel. Furthermore, once the barrel is again set towards the back, if the piston moves forward again in the barrel, the balls move forward on the arms and, because of their shape, they are again propelled rearwards, driving the piston with them, which piston is in the proper firing position.

The invention will be better understood with the help of the following description of the preferred embodiment of the apparatus of the invention, with reference to the appended drawing, in which.

The following description will be given with reference to a sealing apparatus in which the plug guide is fixed with respect to the barrel. However, the applicant does not intend to be limited to this type of apparatus, it being possible for the invention to be applied to any type of apparatus using piston-braking balls, especially apparatuses in which the plug guide is connected to the barrel via a spring and is therefore moveable with respect to the barrel.

Figure 1:
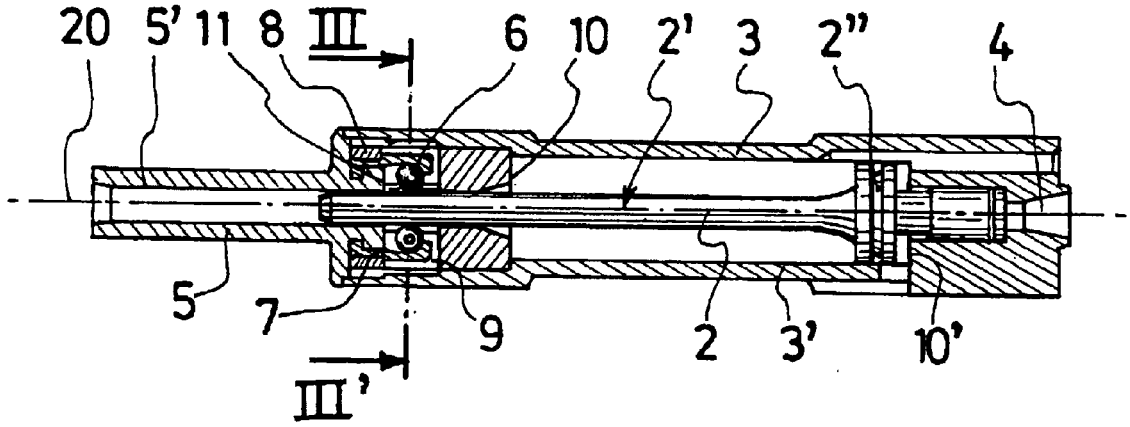
FIG. 1 shows a view in partial section of the preferred embodiment of the apparatus of the present invention.

With reference to FIG. 1, the fastening apparatus comprises a piston 2 mounted so that it can move in a barrel 3 and a plug guide 5, extending along an axis 20. More specifically, the piston 2 comprises a piston head 2" and a piston rod 2'. The rod 2' can be moved in the plug guide 5 in which is provided a cylindrical bore 5' having an axis 20 and a diameter substantially equal to that of the piston rod 2' in order to direct it along the axis 20. The piston head 2" can be moved in the barrel 3 in which is provided a cylindrical bore 3' having an axis 20 and a diameter substantially equal to that of the piston head 2" in order to direct it along the axis 20. The piston 2 can be moved between a firing position, in which the rear of the piston head is close to a surface 10' of the barrel perpendicular to the axis 20, depending on the power setting, so as to close off a combustion chamber 4, and a fastening position, in which the piston head 2" has moved forward in the barrel, into a position at most at the front stop on a rear surface 10 of a damper.

Figure 2:
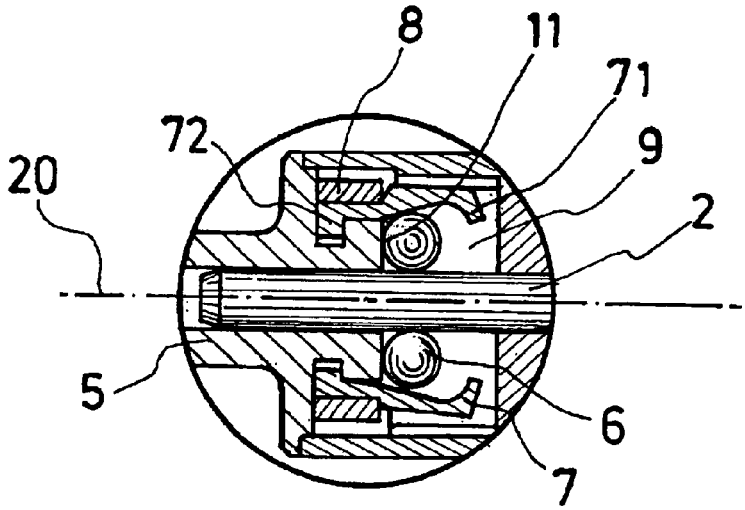
FIG. 2 shows a sectional view of the piston-holding ball mechanism of the apparatus of FIG. 1, when the piston is in the fastening position.
Figure 4:
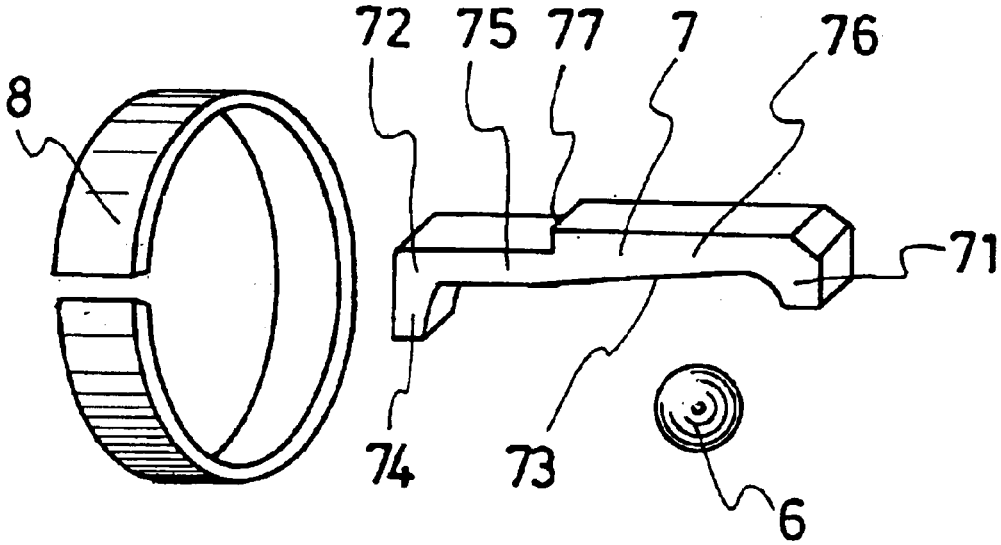
FIG. 4 shows an exploded view of the piston-holding ball mechanism of the apparatus of FIG. 1.

With reference to FIG. 2, the hall 6 mechanism for holding the piston 2 in this case comprises two balls 6, two clamping lever arms 7 and a resilient o-ring 8, in this case made of metal. With reference to FIG. 4, the o-ring 8 consists of a ring which is split in order to allow the mechanism to be mounted and to provide the required resilience. Each arm 7 lies along the axis 20, and comprises a pivoting elbow 72 between a heel 74, pressed into a recess of the plug guide 5, and a forearm 75, which in this case is parallelepipedal, which is clamped between the plug guide 5 and the o-ring 8. Each arm is extended to the rear of the forearm 75, by a rear arm 76 making an external shoulder 77 with the forearm 75, for accommodating the o-ring 8, and the internal surface 73 of which flares rearwards. The rear arm 76 ends in a retaining finger 71 which is substantially perpendicular to the axis 20, intended to retain the ball 6 on the piston 2.

Figure 3:
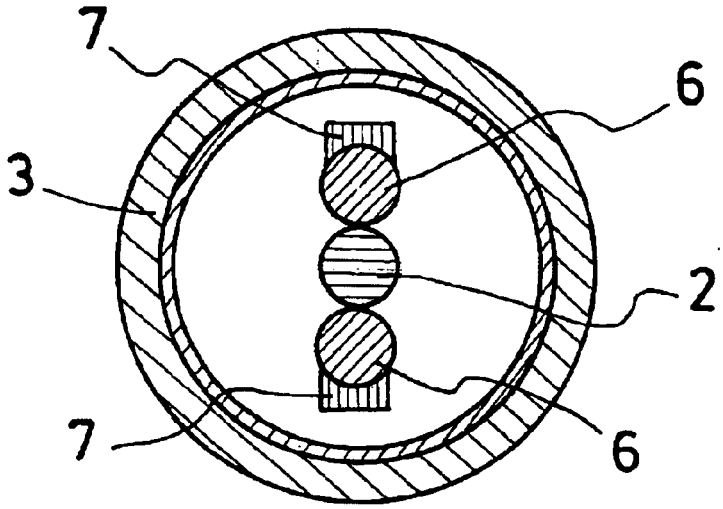
FIG. 3 shows a sectional view, along the axis III–III' of FIG. 1.

With reference to FIG. 3, the arms 7 are mounted on each side of the piston 2, in opposition with respect to the axis 20 of the piston 2. Each ball 6 is trapped between the piston 2 and an associated arm 7.

Each internal arm surface 73 in contact with the ball 6 is in this case a portion of a cylinder inclined on the axis 20 of the piston 2. In other words, the contact surface 73 between each arm 7 and its associated ball 6 is trough-shaped. Moreover, it is the radial thickness of each rear arm 76 that decreases rearwards.

With reference to FIGS. 2 and 4, each ball 6 is arranged in order to roll over its lever arm 7 between the retaining finger 71 at the end of the arm 7, away from the pivoting elbow 72, and a radial abutment edge 11 of the plug guide 5, lying between the pivoting elbow 72 and the retaining finger 71 of the arm 7. Each arm 7 is mounted so that it can pivot against the force from the o-ring 8 and under the force from the associated ball 6 moving forward.

The action of the ball 6 mechanism for braking and holding the piston 2 during various phases of using the fastening apparatus will now be described.

The piston 2 is initially in the firing position, therefore to the rear in the barrel 5, stopped on the surface 10' and completely closing off the combustion chamber 4. The fastening apparatus is pressed on the support into which it is desired to insert a plug and, for safety reasons, firing is only possible once this pressing has been carried out. The force on the trigger causes the explosion of the propellent charge and the expansion of the propellent gases in the combustion chamber 4.

The piston 2 is propelled forward in the barrel 3 against the force of the balls 6. When the piston 2 moves forward, the balls 6 roll by friction over the piston 2 which drives them forward and the articulated arms 7 pivot on the plug-guide 5 to move apart from one another in the region of their fingers 71. The radial force exerted by the arms 7 on the balls 6 and therefore by the balls 6 on the piston 2, due to the increase of the angle formed between the arms 7, increases when the balls 6 move forwards over the arms 7, and therefore during passage from the firing position of the piston 2 to its fastening position. However, because of the large force provided by the propellent gases, the piston can move forwards against the force from the braking balls 6. The balls 6 then stop on the stop surface 11 of the plug guide, as can be seen in FIG. 2. Due to the opening of the arms 7, the braking effort is better metered out and is exerted when it is needed, along the stroke of the piston.

Since the piston 2 is in the fastening position, the apparatus is opened in order to drive the barrel 3 forward, so as to access the combustion chamber and to replace an explosive charge therein. This being done, the piston 2, under the force of return or resetting means, well known to a person skilled in the art and therefore neither shown in the drawing nor described here, moves back relative to the barrel 3. The balls 6 quickly come to a stop on the retaining fingers 71 of the arms 7; the force exerted by the balls 6 on the piston 2 is thus weak but not zero. It is therefore possible to drive the barrel 3 forwards without too much effort, while preventing the piston 2 from being driven with a relative displacement in the wrong direction.

The apparatus is then closed, that is to say that the barrel 3 is driven rearwards. Under the force of the balls 6 for holding the piston 2, the piston is driven with the barrel 3.

The piston 2 and the barrel 3 are then in the firing position. However, a forward movement of the piston 2 relative to the barrel can still be envisaged, for example via rebound. However, a forward movement of the piston 2 relative to the barrel 3 causes the balls 6 to move forward on the arm 7. Because of the engagement of the resilient o-ring 8 and of the arms 7, together with the flaring of the arms 7, this moving forward of the balls 6 immediately causes pressure, on the arms 7 which propel the balls 6 rearwards, by resilience, towards the retaining fingers 71, the latter driving, when reset, the piston 2 which is then in the proper position. Thus moving the piston 2 forward causes an axial return force, from the arms 7 in cooperation with the piston 2, which propels the balls 6 rearwards and the piston with them. The piston is therefore finally properly held in the firing position.

What is claimed is:

1. Fastening apparatus with indirect firing, by means of which a fastening element is driven into a support material under the action of propellent gases from an explosive charge via a piston (2) mounted so that it can move in a barrel (3), between a firing position and a fastening position, and a plug guide (5) in which a piston-braking ball (6) mechanism is mounted, exerting a radial force on the piston (2), and comprising means (7) arranged to modulate the radial force of the balls (6), depending on the relative displacement of the barrel(3) and of the piston (2), between a maximal force when the piston (2) moves forward in the barrel (3), and a non-null minimal force when the piston (2) moves back, apparatus characterized by the fact that the balls (6) are restrained radially by clamping lever arms (7) for modulating the radial action of the balls (6), mounted so that they can pivot on the plug guide (5) under the force of the balls (6) rolling on the arms (7).

2. Apparatus according to claim 1, in which the lever arms (7) are also arranged in order to exert a rearward axial return force on the balls (6), should the latter (6) move forward.

3. Apparatus according to claim 1, in which the balls (6) are arranged in order to roll on the arms (7) between retaining fingers (71) at the end of the arms (7), away from elbows (72) for pivoting the lever arms (7), and a radial abutment edge (11) of the plug guide (5) which lies between the pivoting elbows (72) and the retaining fingers (71) of the arms (7).

4. Apparatus according to claim 1, in which the lever arms (7) are mounted so that they can pivot against the force from a resilient o-ring (8).

5. Apparatus according to claim 1, in which the radial thickness of the lever arm (7) decreases rearwards.

* * * * *